US005148842A

United States Patent [19]

Boust

[11] Patent Number: 5,148,842

[45] Date of Patent: Sep. 22, 1992

[54] FUNNEL-ADAPTER FOR USE IN DISPENSING WATER AND ICE FROM A REFRIGERATOR WATER AND ICE DISPENSER

[76] Inventor: Dale Boust, P.O. Box 3486, Pinedale, Calif. 93650

[21] Appl. No.: 739,477

[22] Filed: Aug. 2, 1991

[51] Int. Cl.[5] ..... B65B 39/00

[52] U.S. Cl. ..... 141/98; 141/333; 193/2 R; 222/460; D7/397; D7/700; D15/89

[58] Field of Search ..... 222/460–462, 222/526, 566, 567; 141/331, 333, 334, 392, 340–345, 98; 220/86.1, 694, 731; D7/397, 398, 700; D23/255, 249; D15/89–91, 79–81, 85, 86; 62/440; 312/236; 193/1, 2 R, 2 A, 4

[56] References Cited

U.S. PATENT DOCUMENTS

| | | | |
|---|---|---|---|
| D. 282,807 | 3/1986 | Hasse | D7/700 |
| D. 288,520 | 3/1987 | Bozarth | D76/398 |
| 288,901 | 11/1883 | Whiting | 141/392 X |
| 564,131 | 7/1896 | Wilkins | 141/98 |
| 771,764 | 10/1904 | Bousser | 222/461 |
| 877,322 | 1/1908 | Gebler | 222/566 |
| 921,941 | 5/9109 | Ballard | 193/2 R |
| 944,940 | 12/1909 | Brandon | 220/731 X |
| 1,040,392 | 10/1912 | Ogle et al. | 193/2 R |
| 1,296,172 | 3/1919 | Drewes | 312/236 X |
| 1,946,760 | 2/1934 | Rhine | 193/2 R |
| 2,104,154 | 1/1938 | Du Bois | 141/334 X |
| 2,116,979 | 5/1938 | Moller | 141/334 |
| 2,411,384 | 11/1946 | Miller et al. | 141/331 X |
| 2,620,957 | 12/1952 | Taylor | 141/334 |
| 2,739,464 | 3/1956 | Smith . | |
| 3,479,206 | 11/1969 | Patterson | 193/2 R X |
| 3,939,884 | 2/1976 | Mader | 141/333 |
| 4,130,147 | 12/1978 | Langlie et al. | 141/98 |
| 4,347,878 | 9/1982 | Schofield | 141/300 |
| 4,458,960 | 7/1984 | Dunst | 312/236 X |
| 4,655,373 | 4/1987 | Essen | 222/465.1 |
| 4,913,201 | 4/1990 | Lucero et al. | 141/334 |

FOREIGN PATENT DOCUMENTS

| | | | |
|---|---|---|---|
| 0044817 | 11/1931 | Denmark | 220/86.1 |
| 0858798 | 12/1952 | Fed. Rep. of Germany | 220/86.1 |
| 0320724 | 12/1902 | France | 141/340 |
| 0954008 | 12/1949 | France | 193/2 R |
| 1165767 | 10/1958 | France | 220/86.1 |
| 0892136 | 3/1963 | France | 222/566 |
| 0126290 | 9/1949 | Sweden | 141/331 |
| 0160005 | 1/1964 | U.S.S.R. | 222/461 |
| 0016023 | 9/1889 | United Kingdom | 222/566 |
| 0003533 | 2/1899 | United Kingdom | 222/462 |
| 0172253 | 12/1921 | United Kingdom | 141/340 |

OTHER PUBLICATIONS

Domus, May, 1987, single page of a Westinghouse refrigerator.

*Primary Examiner*—Henry J. Recla
*Assistant Examiner*—Casey Jacyna
*Attorney, Agent, or Firm*—Milton S. Gerstein

[57] ABSTRACT

A funnel-adapter that allows one to fill up a large pitcher or jug directly from the ice or water dispensing unit of a conventional water/ice dispenser unit of a refrigerator. The funnel-adapter has a main, curved-shaped, hollow main frame that is opened at its top and at its bottom. The curvature of the adapter is such that the horizontal lower open end is offset from the horizontal, upper open end, so that when the upper open end is inserted into a water/ice dispenser of a refrigerator and pushed against one of the actuator switches for causing the dispensing of ice or water, the lower open end will be horizontally spaced outwardly of the air space of the water/ice dispenser, so that a large pitcher or container, to be filled with water or ice, may be located directly under the lower open end for funneling the dispensed water or ice into the interior volume of the pitcher or container.

4 Claims, 1 Drawing Sheet

FUNNEL-ADAPTER FOR USE IN DISPENSING WATER AND ICE FROM A REFRIGERATOR WATER AND ICE DISPENSER

BACKGROUND OF THE INVENTION

The present invention is directed a funnel for use with a water/ice dispenser of a refrigerator. A water/ice dispenser of a refrigerator is contained in a relatively small space in the freezer door of a conventional refrigerator. A separate water-dispensing section and a separate ice-dispensing section are commonly provided. In using the water/ice dispenser, one places the glass, cup, or the like, on the lower, horizontal support, in close juxtaposition to the water or ice dispensing nozzle, and, thereafter, pushes against the respective actuator-switch to cause the dispensing process to occur. The problem with these water/ice dispensers is that the space in which it is formed in the refrigerator door does not allow of insertion of a pitcher, jug, or any type of container that has a height greater than the height of the dispensing chamber-space, as measured from the lower support to the upper partition thereof. Thus, for one to fill up a large pitcher with ice or cold water from the water/ice dispenser of a refrigerator, one must first use a smaller container that is receivable in the small dispensing space, and repeatedly fill it up and dispense its contents into the larger pitcher or jug. This, of course, is a very time-consuming ordeal, since, typically, the intermediate, smaller container is a glass, since the water/ice dispenser of a refrigerator typically is designed to only receive a glass. Because of this time-consuming ordeal, one usually will not use the water/ice dispenser of a refrigerator to fill up large pitchers or jugs, and will settle for using water from a tap of a sink.

SUMMARY OF THE INVENTION

It is the primary objective of the present invention to provide and adapter, acting as a funnel, that allows one to fill up a large pitcher or jug directly from the ice or water dispensing unit of a conventional water/ice dispenser-unit of a refrigerator.

It is another objective of the present invention to provide such a funnel-adapter which obviates the need for placing the receiving container directly into the air space of the water/ice dispenser of the refrigerator, thereby overcoming the size-limitations associated with these water/ice dispensers of refrigerators.

Toward these and other ends, the funnel-adapter of the invention has a main, curved-shaped hollow, main frame that is open at its top and at its bottom. The curvature of the adapter is such that the horizontal, lower, open end is offset from the horizontal, upper, open end, so that when the upper end is inserted into a water/ice dispenser of a refrigeration and pushed against one of the actuator-switches for causing the dispensing of ice or water, the lower end will be horizontally-spaced outwardly of the air space of the water/ice dispenser, so that a large pitcher or container to be filled with water or ice may be located directly under the lower, open end for funneling the dispensed water or ice into the interior volume of the pitcher or container. The curvature of the funnel-adapter is such that for all types and makes of water/ice dispensers of refrigerators, the lower, open end will cause the dispensed water or ice to be deflected in a direction exteriorly of the air space of the water/ice dispenser of the refrigerator.

BRIEF DESCRIPTION OF THE DRAWING

The invention will be more readily understood with reference to the accompanying drawing, wherein.

DETAILED DESCRIPTION OF THE INVENTION

Figure 1:
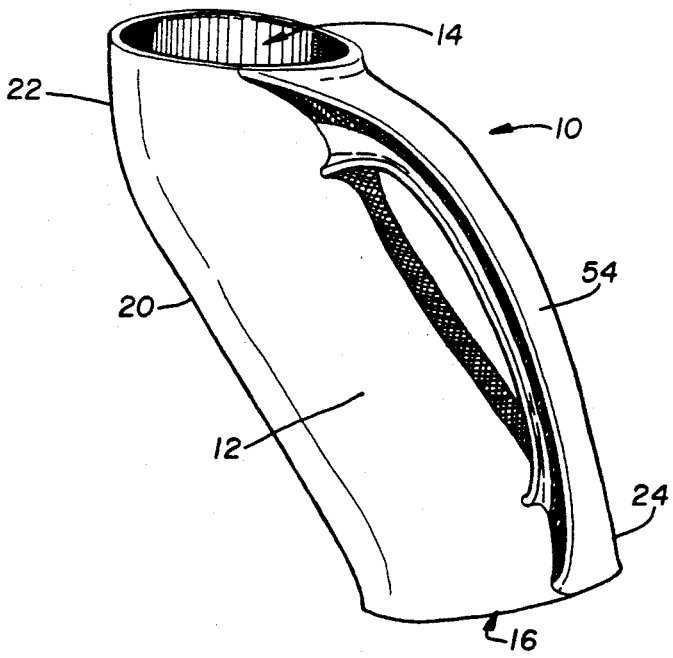
FIG. 1 is an isometric view of the funnel-adapter for use with a water/ice dispenser of a refrigerator.
Figure 2:
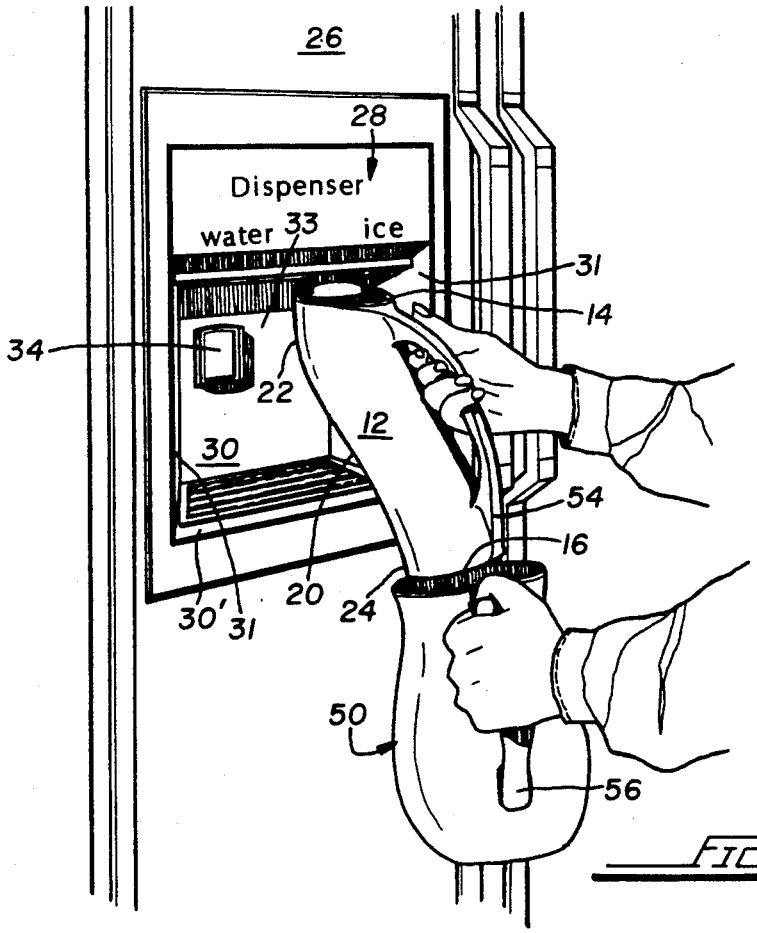
FIG. 2 is an isometric view showing the funnel-adapter of the invention in use for a water/ice dispenser of the refrigerator for filling up a large pitcher thereby.

Referring now to the drawings in greater detail, the funnel-adapter for use with a water/ice dispenser of a refrigerator is indicated generally by reference numeral 10. The funnel-adapter 10 has a main, outer housing 12 with a hollow, interior-volume therethrough, which defines a substantially-horizontal, open, upper end or entrance 14, and a substantially-horizontal, open, lower end or exit-mouth 16. The exit-mouth 16 is laterally, horizontally offset from the entrance 14, such that the center of radius of the exit-mouth 16 is laterally, horizontally spaced from the center of radius of the entrance 14. This offset is achieved by the curved nature of the main housing 12, which curved nature, in the preferred embodiment, assumes, in cross section, the shape of a third-degree polynomial, to thus define an intermediate, connecting, transition portion, or inflection, 20 between a first, substantially-vertical leg-section 22 of the main housing 12, and a second, substantially-vertical leg-section 24 of the main housing. The length of the first leg-section 22, as measured from its entrance 14 to its end connected to the transition-portion 20, is less than the height of a chamber 30 of a water/ice dispenser 28 of a refrigerator 26, so as to ensure that the first leg-section 22 may be inserted into the chamber 30, with its upper end pushed against a dispensing actuator 34 of the chamber 30, for causing water or ice to be dispensed. The chamber 30 has an open, exterior entrance for accessing the chamber, a lower, horizontal support-surface 30', side walls 31, a rear partition 33, and a top partition wall, in which top wall are mounted dispensing actuators for water and/or ice. The transition-portion 20 has a horizontal span such that the second, vertical leg section 24 is positioned exteriorly of the chamber 30 when the entrance 14 is pushed against the dispensing actuator 34. The length of the first, vertical leg-section is preferably that which permits its insertion into a chamber 30 for all sizes and makes of water/ice dispensers of refrigerators.

In using the funnel-adapter 10, one first places the first, vertical section 22 in the chamber 30 until the entrance 14 is positioned directly below a chosen dispensing actuator. Then, the funnel-adapter is pushed rearwardly toward the rear partition 23 for dispensing water or ice which flows directly into the open entrance 14, down through the first, vertical leg section 22, through the transition-portion 20, down through the second, vertical leg-section, and, then, out through the exit-mouth 16, and directly into a pitcher 50, or other large container positioned below the exit-mouth 16. In order to assist in holding the funnel-adapter and pushing into the chamber, an elongated handle 54 is provided. Typically, the pitcher 50 to be filled will also have a handle 56, so that one holds the funnel-adapter 10 in one hand for dispensing the water or ice, and holds the pitcher 50 below the exit-mouth 16 with his other hand.

Of course, the funnel-adapter may be configured differently, and still perform the same function and use as above-described. For example, the curve of the main housing 12 need not be as shown, but instead may have the shape, in cross section, of a second degree polynomial, such as a section of a parabola, or the like, as long as the entrance may be positioned within the chamber 30 and against a dispensing actuator, with the exit mouth thereof positioned below the entrance and exteriorly of the chamber 30. Also, the exit-mouth 16 is shown as being substantially horizontal, although a canted end may also be employed, and even one that is substantially vertically oriented. In addition, while it is preferable that the exit-mouth be positioned exteriorly of the chamber 30, when using a vertically-oriented exit mouth, such may even be positioned within the open, exterior entrance of the chamber 30, with the kinetic energy of the flowing water or ice ensuring that it will clear the chamber 30 and enter into a pitcher in close juxtaposition to the exit mouth of the funnel-adapter.

Another preferred version if a linear-shaped main housing with its upper end canted, so as to be substantially horizontal when inserted into the chamber 30 and pushed against the dispensing actuator. In so orienting the upper end or entrance of the housing horizontally in the chamber, the main housing, being linear, will then project angularly away from the chamber and exit it, so that the lower exit-mouth will be located exteriorly of the chamber.

While a specific embodiment of the invention has been shown and described, it is to be understood that numerous changes and modifications may be made therein without departing from the scope, spirit and intent of the invention as set forth in the appended claims.

What I claim is:

1. In a refrigerator having a dispensing system comprising an front-opening chamber having a lower support surface and a rear surface, and at least one of a water-dispensing unit comprising a dispensing actuator and an ice-dispensing unit comprising a dispensing actuator, said open chamber having an upper partition defining the height of said chamber, the improvement comprising:

a funnel-adapter comprising a main housing having a hollow interior having an open, upper end and open, lower end; said main housing being hollow therethrough, said lower end being offset from said upper end, whereby a large container having a height and/width greater than the height or width of the chamber may be filled by said dispensing system;

said main housing comprising a first, upper portion, and a second, lower portion; said first, upper portion upwardly-terminating in said open, upper end, and said second, lower portion terminating in said open, lower end; said first, upper portion having a height less than said height of said chamber, and a width less than the width of said chamber for reception in said chamber, said first upper portion being periodically, when in use, in surface-to-surface depressing contact against said dispensing actuator;

said first, upper portion comprising a bottom end, and said second, lower portion comprises a top end; said main housing further comprising an intermediate, transition-portion connecting said bottom end to said top end;

said intermediate transition-portion offsetting said second lower portion from said first upper portion, such that said second, lower portion projects outwardly of said chamber, with said lower end of said second, lower portion located laterally outwardly of said chamber, in order to access the interior of a large container;

and further comprising a container having a height greater than the height of said chamber; said lower end communicating with the interior of the container for directing the contents of said dispensing unit to the interior of said container.

2. The improvement according to claim 1, wherein said main housing is curved, in cross section, and is in the shape of a polynomial.

3. The improvement according to claim 2, wherein said polynomial is of the third order.

4. The refrigerator according to claim 1, wherein said main housing comprises a separate handle element comprising an elongated section having a first upper end and a second lower end, said upper and lower ends being connected to said upper and lower portions, respectively, of said main housing, said elongated section between said upper and lower ends being spaced from said intermediate transition portion to define a space therebetween in which a hand may be received, said handle element being used for manually gripping and holding the funnel-adapter while in said chamber.

* * * * *